US012584501B2

(12) United States Patent
Iannucci et al.

(10) Patent No.: US 12,584,501 B2
(45) Date of Patent: Mar. 24, 2026

(54) OIL-LUBRICATED VACUUM PUMP WITH IMPROVED OIL SEALING

(71) Applicant: Agilent Technologies, Inc., Santa Clara, CA (US)

(72) Inventors: Giovanni Iannucci, Casserta (IT); Giuseppe De Palma, Turin (IT); Andrea Lepore, Cassino (IT); Simone Cau, Settimo Torinese (IT); Cristiano Bruno, Settimo Torinese (IT); Claudio Caputo, Turin (IT); Vito Apicella, Settimo Torinese (IT)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 18/752,669

(22) Filed: Jun. 24, 2024

(65) Prior Publication Data

US 2025/0003427 A1 Jan. 2, 2025

(30) Foreign Application Priority Data

Jun. 30, 2023 (GB) ..... 2309982

(51) Int. Cl.
*F04D 29/70* (2006.01)
*F04C 25/02* (2006.01)
(Continued)

(52) U.S. Cl.
CPC ..... *F04D 29/701* (2013.01); *F04D 25/06* (2013.01); *F04D 29/063* (2013.01)

(58) Field of Classification Search
CPC ..... F04C 18/344; F04C 2220/50; F04C 2240/806; F04C 25/02; F04C 27/00;
(Continued)

(56) References Cited

U.S. PATENT DOCUMENTS 4,123,201 A * 10/1978 Andriulis ..... F04C 27/02 464/147
5,697,771 A * 12/1997 Arndt ..... F04C 23/001 418/87
(Continued)

FOREIGN PATENT DOCUMENTS

CN 116201731 A 6/2023
EP 0714482 B1 5/1997
(Continued)

OTHER PUBLICATIONS

Leybold, Sogevac SV300 B Single Stage, Oil-sealed Rotary Vane Pump Operating Instructions, https://www.leyboldproducts.com/media/pdf/68/45/3c/300270042_002_C0_SV300B_EN.pdf; Nov. 2016; 38 pages.
(Continued)

*Primary Examiner* — Eric J Zamora Alvarez

(57) ABSTRACT

A vacuum pumping system includes an oil-lubricated rotary vacuum pump, an electric motor driving the pump and a gas ballast arrangement supplying the pump with gas and fluidically coupled with the motor for sucking oil, leaked from the pump into the motor, back into the pump. The fluidic coupling is achieved by means of a leaked oil recovery unit that is housed in a region of an internal chamber of the motor where ballast gas and leaked oil are present and that establishes communication between the region of the internal chamber of the motor and the pumping chamber.

10 Claims, 5 Drawing Sheets

(51) Int. Cl.

| | |
|---|---|
| ***F04C 27/00*** | (2006.01) |
| ***F04C 29/02*** | (2006.01) |
| ***F04D 25/06*** | (2006.01) |
| ***F04D 29/00*** | (2006.01) |
| ***F04D 29/063*** | (2006.01) |

(58) Field of Classification Search
CPC ..... F04C 27/02; F04C 27/009; F04C 29/02; F04C 2220/10; F04C 28/28; F04C 23/008; F04C 28/24; F04C 29/026; F04C 29/0007; F04C 14/06; F04C 2240/809; F04C 23/02; F04C 29/122; F04C 11/00; F04C 2210/206; F04C 2240/10; F04C 2240/30; F04C 23/00; F04C 29/025; F05B 2260/95; F04D 25/06; F04D 29/063; F04D 29/701
See application file for complete search history.

(56) References Cited

U.S. PATENT DOCUMENTS 6,123,516 A * 9/2000 Burghard ..... F04B 25/00 417/267
6,149,414 A 11/2000 Abelen et al.

FOREIGN PATENT DOCUMENTS

EP 1249648 B1 5/2006
JP 2013249765 A 12/2013

OTHER PUBLICATIONS

UK Intellectual Property Office Search Report under Section 17 for application No. GB2309982.3 dated Nov. 28, 2023; 4 pages.

* cited by examiner

OIL-LUBRICATED VACUUM PUMP WITH IMPROVED OIL SEALING

CROSS-REFERENCE TO RELATED APPLICATIONS

This application claims priority to British Patent Application No. GB 2309982.3, filed Jun. 30, 2023, titled "OIL-LUBRICATED VACUUM PUMP WITH IMPROVED OIL SEALING," the entire contents of which is incorporated by reference herein.

TECHNICAL FIELD

The present invention relates to vacuum pumping systems and more particularly it concerns a vacuum pumping system having an oil-lubricated rotary vacuum pump with improved oil scaling.

BACKGROUND

Vacuum pumps are used to achieve vacuum conditions, i.e. for evacuating a chamber (so-called "vacuum chamber") and establishing sub-atmospheric pressure conditions in said chamber. Many different kinds of vacuum pumps, having different structures and operating principles, are known and each time a specific vacuum pump is to be selected according to the needs of a specific application, namely according to the degree of vacuum that is to be attained in the corresponding vacuum chamber.

In general, a vacuum pump comprises a pump casing, in which one or more pump inlets and one or more pump outlets are provided, and pumping elements, arranged in said pump casing and configured for pumping a gas from said pump inlet(s) to said pump outlet(s): by connecting the pump inlet(s) to the vacuum chamber, the vacuum pump allows the gas in the vacuum chamber to be evacuated, thus creating vacuum conditions in said chamber.

In a kind of vacuum pumps, the pumping elements comprise a stator defining a pumping chamber and a rotor rotatable in said pumping chamber and cooperating with the stator for pumping the gas from the pump inlet(s) to the pump outlet(s). In such vacuum pumps, the rotor is generally mounted to a rotating shaft which is driven by an electric motor.

Such pumps are often connected to an oil tank, whereby oil can be transferred from the oil tank to the vacuum pump, and in particular to the pumping chamber, for acting as coolant and lubricating fluid and for sealing the chamber, as well as for protecting the pump components from possible corrosive actions by the gas being pumped. Among such systems, those using rotary vane vacuum pumps can be mentioned, and the following description will refer to a system of that kind.

A conventional vacuum pumping system using an oil-lubricated rotary vane vacuum pump is shown in FIG. 1 and is generally denoted 10.

Pumping system 10 essentially comprises the actual vacuum pump 20 and an electric motor 30 for driving pump 20. Only the portion of pump 20 adjacent to motor 30 is shown for the sake of simplicity.

Pump 20 comprises a pump casing 21 in which one or more pump inlets and one or more pump outlets (not shown in the Figure) are defined. Pump casing 21, which acts also as pump stator, internally defines a pumping chamber in which a pump rotor 23 eccentrically rotates. Rotor 23 is fastened to or integral with a pump shaft 24 driven in rotation by motor 30 and is provided with one or more radially slidable vanes 25 (only one being visible in the drawing) that, during rotation of the rotor, move in contact with the inner walls of the pumping chamber. As known, in such kind of pump, oil is introduced into the pumping chamber for lubricating and cooling the pump and separating the regions at different pressures.

In case the pump is equipped with a gas ballast arrangement, a further inlet (also not shown in the Figure) for introducing the ballast gas, typically air, into the pumping chamber is defined in pump casing 21.

Motor 30 in turn comprises a casing 31, fastened to pump casing 21 and enclosing a motor stator 32 and a motor rotor 33. Motor stator 32 and motor rotor 33 cooperate with each other so as to drive pump rotor 23 into rotation by means of a drive shaft 34, associated with motor rotor 33. Drive shaft 34 can be coupled to pump shaft 24 or it can be made as an integral unit with pump shaft 24 and pump rotor 23, as shown in the Figure. End walls 35, 36 close a chamber housing motor rotor 33 and rotatably support, in association with suitable rolling bearings, the end portions of shaft 34.

To prevent oil and possibly toxic gases present in the pumping chamber from passing to motor 30 and escaping into the environment through motor casing 31, a dynamic radial scal 40, typically a lip seal, is provided around shaft 34 between motor casing 31 and pump casing 21. The dynamic seal is also to prevent dust from entering the pumping chamber.

In the case of rotary vane vacuum pumps, the dynamic seal is the main cause of oil leaks during operation of the pump. Oil leaks are obviously undesirable since the resulting reduction in the amount of oil present in the pumping chamber could impair the effectiveness of the oil action. Moreover, as said, the oil could contain toxic gases that could be a source of pollution and danger if they would escape into the environment through motor casing 31.

EP 1249648 B1 discloses an improved radial lip seal for a rotating shaft, with a surface profile configured to cause leaked fluid to be conveyed back into the space to be sealed when the shaft rotates. The improved seal disclosed in this prior art document has a complex structure making it rather expensive. Moreover, no provision is made for dealing with fluid not conveyed back into the space to be sealed.

EP 714482 B1 discloses an oil-lubricated rotary vane vacuum pump with gas ballast, in which oil collected from the oil separator arranged downstream the pump outlet is returned to the pump through the gas ballast inlet. The pump has sealing rings sealing the pump shaft against a bearing piece, but it has no provision for dealing with possible oil leaks from the pumping chamber, and hence it cannot guarantee a completely sealed pumping module.

SUMMARY

It is an object of the present invention to provide a vacuum pumping system solving the problems mentioned above of the prior art.

It is another object of the present invention to provide a vacuum pumping system having an oil-lubricated rotary vacuum pump equipped with means for dealing in simple and effective manner with oil leaks from the pumping chamber.

More particularly, the invention provides a vacuum pumping system comprising an oil-lubricated rotary vacuum pump, an electric motor driving the pump and a gas ballast arrangement supplying the pump with gas, in which the gas ballast arrangement is fluidically coupled with the motor for sucking oil, leaked from the pump into the motor, back into the pump.

The gas ballast arrangement is configured to provide for a permanent gas ballast.

Advantageously, the gas ballast arrangement is fluidically coupled with the motor by means of a leaked oil recovery unit that is housed in a region of an internal chamber of the motor where gas from the gas ballast arrangement and leaked oil are present. The gas ballast arrangement is arranged to establish communication between said region of the internal chamber of the motor and the pumping chamber. That region is moreover faced by a dynamic radial seal preventing oil present in the pumping chamber from passing to the motor.

In a preferred embodiment of the invention, the leaked oil recovery unit includes a pipe that has a first end located adjacent to the seal and a second end cooperating with a non-return valve interposed between said second end of the pipe and said pumping chamber and configured to allow oil collected by the pipe to pass to the pumping chamber together with the ballast gas when the pump is switched on and to prevent oil leakage towards the motor when the pump is switched off.

Advantageously, the non-return valve is a ball-and-spring valve.

According to another advantageous feature of the invention, the non-return valve is received in a seat, a section of which is formed with a calibrated orifice regulating the flow of ballast gas directed to the pumping chamber and acting as a gas inlet for the pumping chamber.

In an embodiment of the invention, the non-return valve is associated with the second end of the pipe and the section of the valve seat with the calibrated orifice is formed between the valve and the pumping chamber and directly opens into the pumping chamber.

In an alternative embodiment, the section of the valve seat with the calibrated orifice is formed between the second end of the pipe and the non-return valve.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

In FIGS. 2 to 5, the same reference numerals as in FIG. 1 have been used to denote equal or functionally equivalent elements.

DETAILED DESCRIPTION

Figure 1:
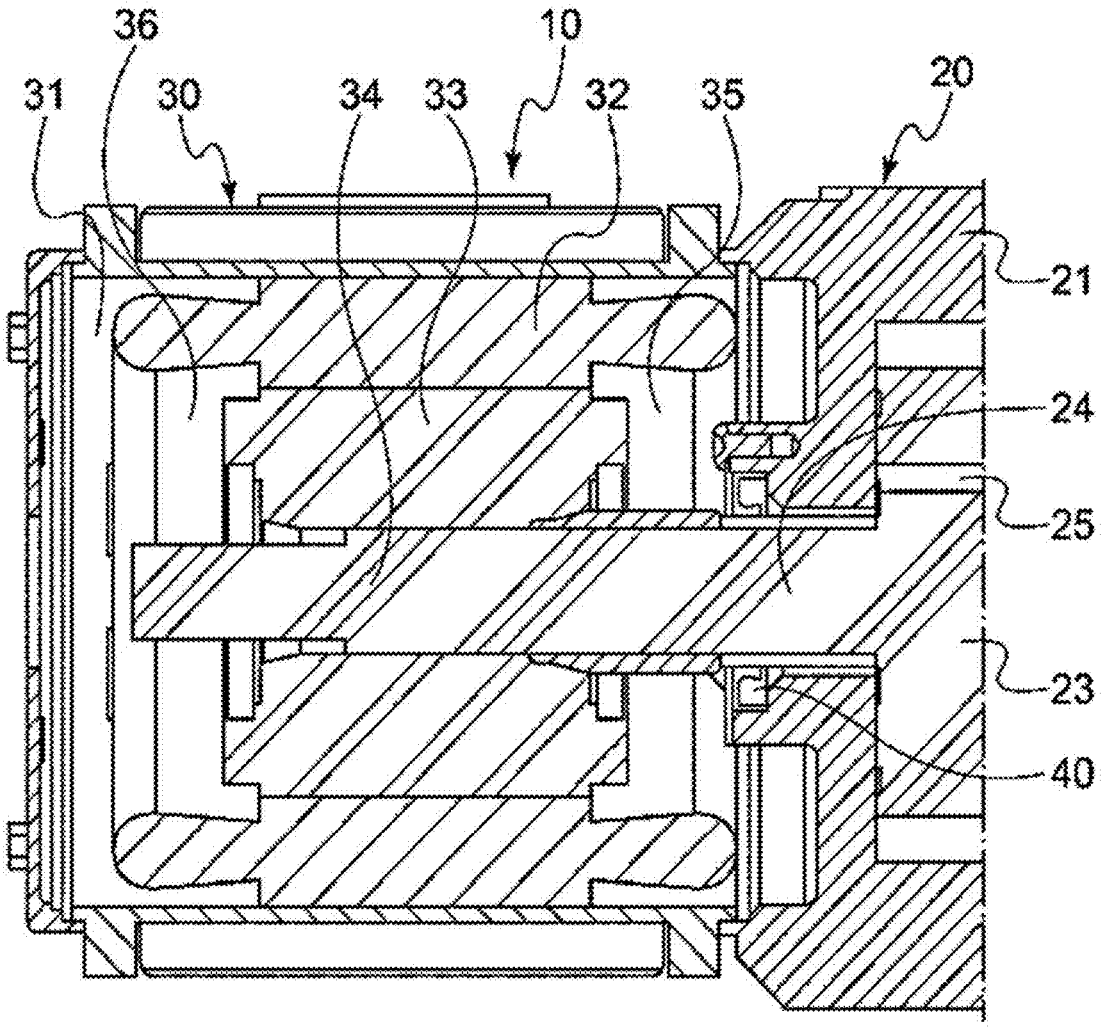
Fig. 1 (PRIOR ART)
FIG. 1 is a longitudinal sectional view of part of a pumping system of the prior art.
Figure 2:
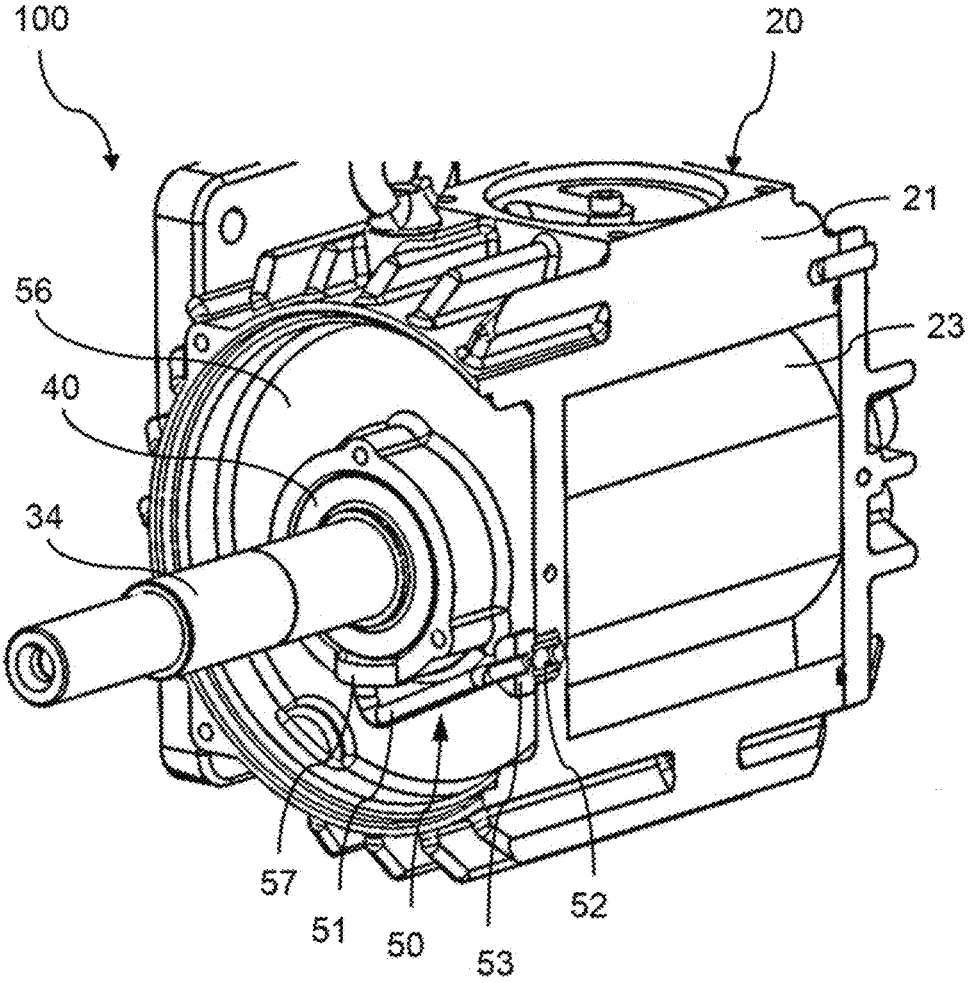
FIG. 2 is a perspective view of a pump employed in a pumping system according to the invention, with the leaked oil recovery unit assembled in its operating position.
Figure 3:
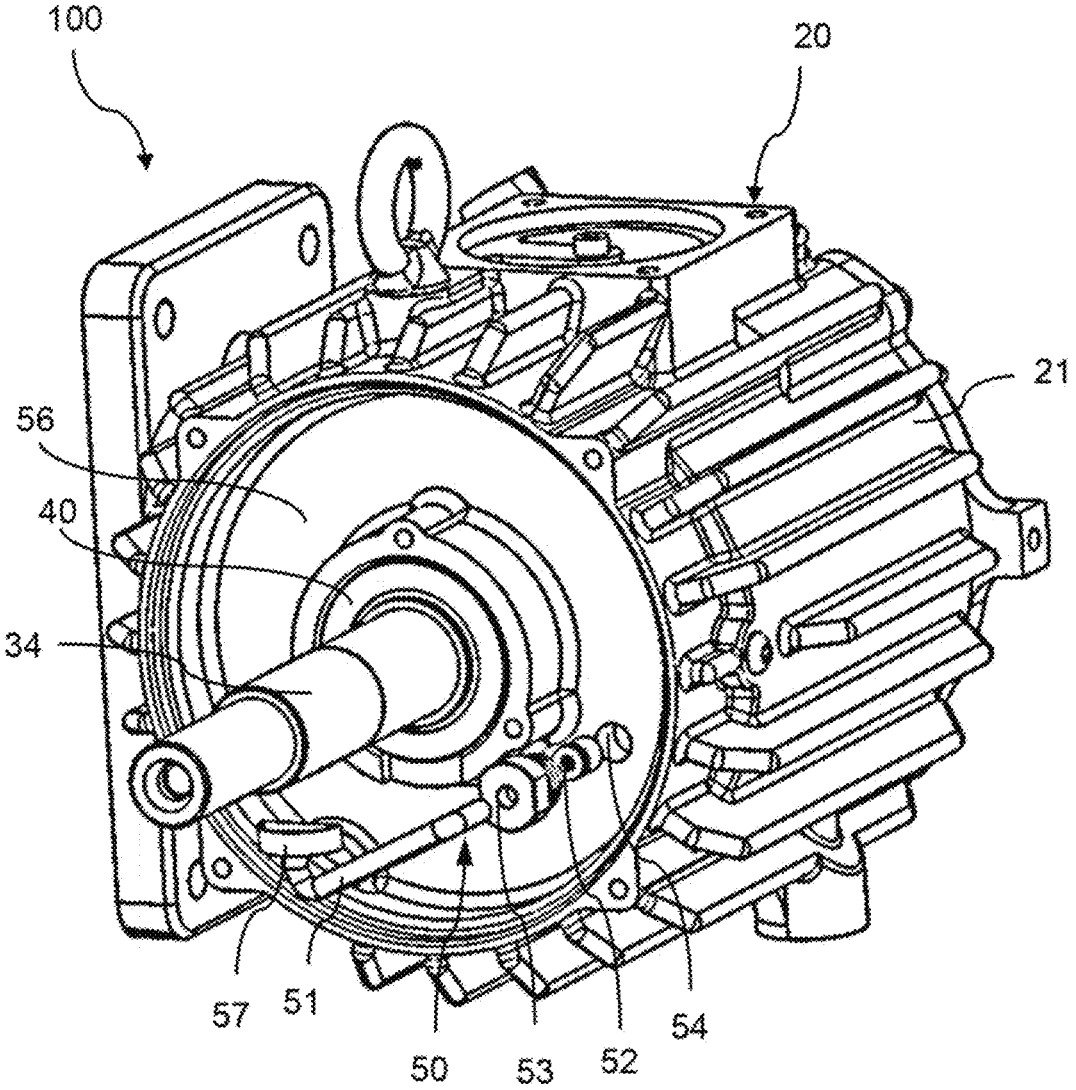
FIG. 3 is a view similar to FIG. 2, with the leaked oil recovery unit in exploded view.

Referring now to FIGS. 2 to 5, the invention applies to vacuum pumping systems 100 equipped with a gas ballast arrangement, in particular an arrangement providing for a permanent gas ballast for reasons that will be explained below. According to the invention, the gas ballast arrangement is fluidically coupled with the motor 30 for sucking oil, leaked from the pump 20 into the motor 30, back into the pump 20.

The gas ballast arrangement, when considered alone, is wholly conventional and therefore it is not shown in detail in these Figures. Moreover, the motor structure is not affected by the invention and hence, for the sake of simplicity, only the drive shaft 34 with the seal 40 is shown in the Figures.

The fluidic coupling is achieved by means of a leaked oil recovery unit 50 located in a region of the internal chamber of the motor 30 housing the motor rotor 33 (FIG. 1) that is faced by the seal 40 and that receives oil possibly leaking from the pumping chamber (defined by the pump casing 21). Also the gas, typically air, supplied by the gas ballast arrangement is present in that region.

The leaked oil recovery unit 50 includes a pipe 51 establishing communication between [said] the above-noted region and the pumping chamber. One end of pipe 51 is arranged adjacent to the seal 40 and the other end is connected to a non-return valve 52 of the gas ballast arrangement. The non-return valve 52 is mounted in a support 53 received in a seat 54 formed with a calibrated orifice 55, which is intended to regulate the flow of air directed to the pumping chamber and which acts as an inlet for leading such air to the pumping chamber. In the illustrated embodiment, the section of the seat 54 with the orifice 55 is located between the non-return valve 52 and the pumping chamber and the orifice 55 opens directly into the pumping chamber. The non-return valve 52 and the orifice 55 thus define a ballast channel between the motor interior and the pumping chamber.

Figure 4:
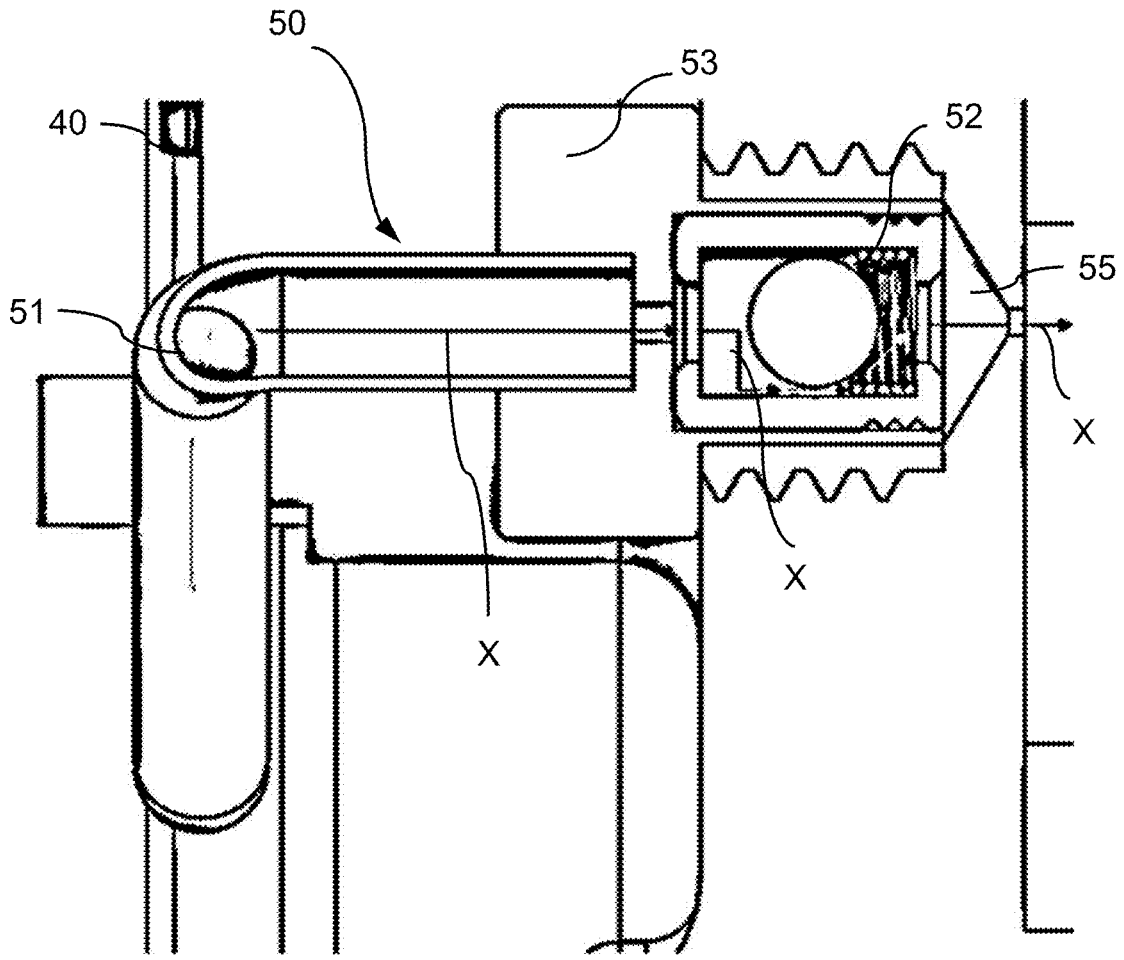
FIG. 4 is an enlarged cross-sectional view of the leaked oil recovery unit in the switched-on condition of the pump.
Figure 5:
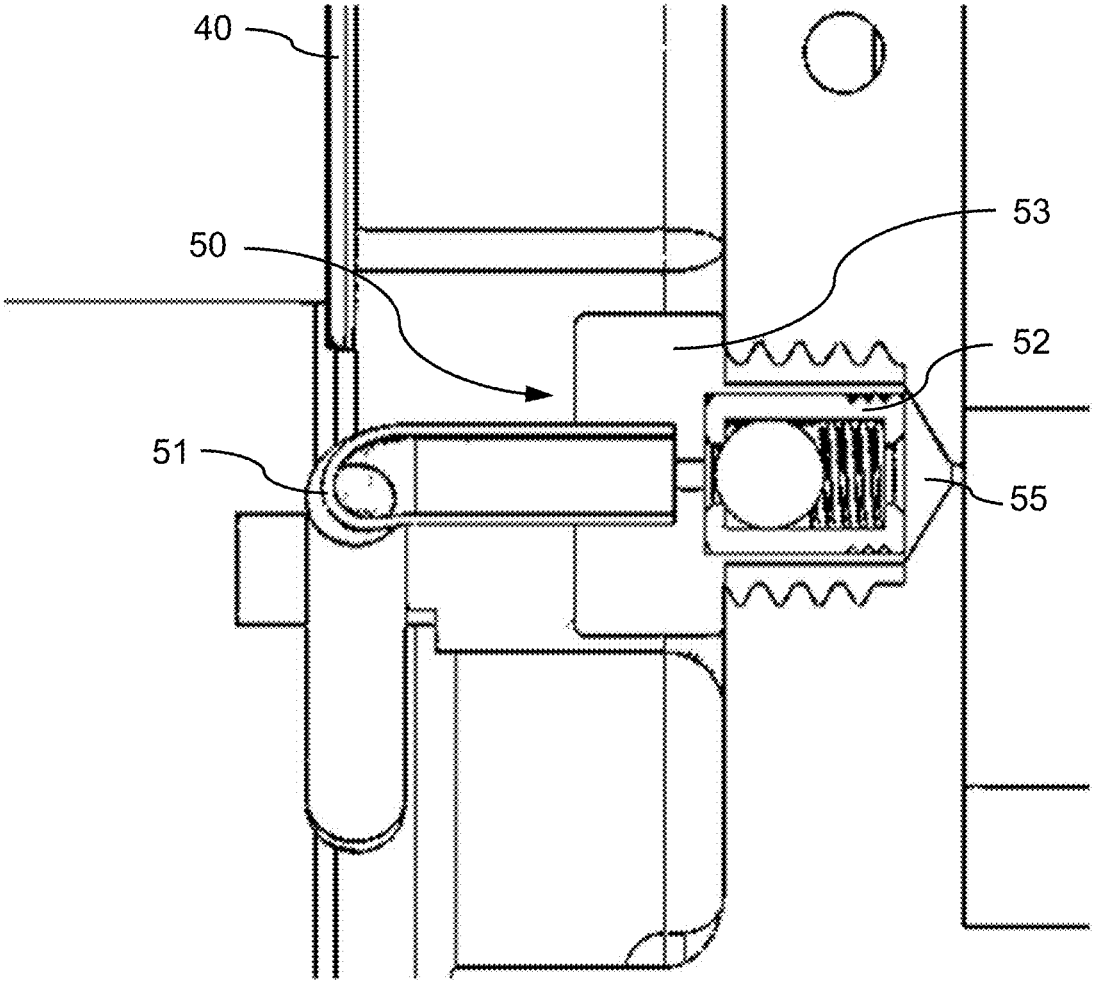
FIG. 5 is an enlarged cross-sectional view of the leaked oil recovery unit in the switched-off condition of the pump.

Non-return valve 52 is advantageously of the ball-and-spring type, as shown in FIGS. 4 and 5, and it is configured to allow air and oil collected by pipe 51 to pass to the pumping chamber when pump 20 is switched on (FIG. 4) and to prevent oil leakage towards motor 30 when pump 20 is switched off (FIG. 5). The path of the combined flow of air and oil to the pumping chamber through unit 50 is indicated by arrows X in FIG. 4.

The seat 54 with the calibrated orifice 55 is mounted or directly machined in a wall 56 separating the pumping chamber from the above-noted region of the internal chamber of motor 30.

By the arrangement disclosed, if and only if the dynamic seal 40 starts to lose oil, the pipe 51 drives the leaked oil together with the ballast air first through the non-return valve 52, then through the calibrated orifice 55 (i.e., through the ballast channel), and finally directly inside the vacuum pump 20.

This occurs automatically, taking advantage of the vacuum obtained inside pump 20 that gives rise to a pressure difference causing the leaked oil to be sucked. This suction is enabled by the continuous flow of the ballast air, which is absolutely necessary for the operation of the leaked oil recovery unit 50 because the pressure in the area of oil leakage is not enough to guarantee a pressure difference that allows sucking back the oil. So, the oil is collected into a collecting bowl 57 connected to the end of pipe 51 adjacent to the seal 40 and then it can be sucked back into the pumping chamber through the ballast channel, which is properly designed so as to open in an area where the pressure obtained inside the pump is able to allow the process of the invention.

Thus, the invention provides a simple, and hence cost-effective, means for guaranteeing a complete sealing of the pumping chamber against oil leaks. No particular working is required for arranging the leaked oil recovery unit 50 in the vacuum pumping system 100, since the existing inlet for the ballast gas is used for reintroducing the recovered oil into the pumping chamber. The use of the existing inlet for the ballast gas also for reintroducing the recovered oil into the pumping chamber, besides contributing to the cost-effectiveness, has the further advantage that it is particularly suitable for retrofitting.

Of course, while leaving the principle of the invention unchanged, the construction details can be widely changed with respect to what has been described and shown by way of non-limiting example only, without thereby departing from the scope of the invention as defined in the following claims.

For instance, the positions of non-return valve 52 and calibrated orifice 55 could be reversed with respect to what is shown in the drawings. Whatever the arrangement, the ballast air can arrive at the pumping chamber through valve 52 when a certain pressure difference generated by pump 20 is established, which causes compression of the spring of valve 52 and displacement of the ball, thereby opening a channel through which the air arrives.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A vacuum pumping system, comprising:

an oil-lubricated rotary vacuum pump;

an electric motor configured to drive the pump; and a gas ballast arrangement configured to supply the pump with gas, wherein the gas ballast arrangement is fluidically coupled with the motor and is further configured to suck oil, leaked from the pump into the motor, back into the pump.

2. The vacuum pumping system according to claim 1, wherein the gas ballast arrangement comprises a permanent gas ballast.

3. The vacuum pumping system according to claim 1, wherein the gas ballast arrangement is fluidically coupled with the motor through a leaked oil recovery unit that is housed in a region of an internal chamber of the motor where gas from the gas ballast arrangement and leaked oil are present and is configured to establish communication between the region of the internal chamber of the motor and a pumping chamber of the pump.

4. The vacuum pumping system according to claim 3, wherein the region of the internal chamber of the motor is faced by a dynamic radial seal configured to prevent oil from passing from the pump to the motor.

5. The vacuum pumping system according to claim 4, wherein:

the leaked oil recovery unit comprises a pipe;

the pipe comprises a first end located adjacent to the seal and a second end cooperating with a non-return valve that is interposed between the second end and the pumping chamber; and the leaked oil recovery unit is configured to allow air and oil collected by the pipe to pass to the pumping chamber when the pump is switched on and to prevent oil leakage towards the motor when the pump is switched off.

6. The vacuum pumping system according to claim 5, wherein the non-return valve is a ball-and-spring valve.

7. The vacuum pumping system according to claim 5, wherein the non-return valve is received in a seat of which a section is formed with a calibrated orifice regulating the ballast gas directed to the pumping chamber and acting as a gas inlet for the pumping chamber.

8. The vacuum pumping system according to claim 7, wherein the non-return valve is associated with the second end of the pipe and the section of the seat is formed between the valve and the pumping chamber and directly opens into the pumping chamber.

9. The vacuum pumping system according to claim 7, wherein the section of the seat is formed between the second end of the pipe and the valve.

10. The vacuum pumping system according to claim 5, wherein the leaked oil recovery unit comprises a collecting bowl associated with the first end of the pipe and configured to collect the oil leaked from the pump into the motor.

* * * * *